US009868600B2

(12) United States Patent
Oya et al.

(10) Patent No.: US 9,868,600 B2
(45) Date of Patent: Jan. 16, 2018

(54) SHEET CONVEYING DEVICE AND IMAGE FORMING APPARATUS

(71) Applicant: CANON KABUSHIKI KAISHA, Tokyo (JP)

(72) Inventors: Yoji Oya, Mishima (JP); Satoshi Tsuda, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/381,689

(22) Filed: Dec. 16, 2016

(65) Prior Publication Data

US 2017/0176913 A1 Jun. 22, 2017

(30) Foreign Application Priority Data

Dec. 21, 2015 (JP) ..... 2015-248515

(51) Int. Cl.

| | |
|---|---|
| ***B65H 3/44*** | (2006.01) |
| ***B65H 85/00*** | (2006.01) |
| ***B65H 3/66*** | (2006.01) |
| ***B65H 5/26*** | (2006.01) |
| ***B65H 5/36*** | (2006.01) |

(52) U.S. Cl.

CPC ..... *B65H 3/44* (2013.01); *B65H 3/66* (2013.01); *B65H 5/26* (2013.01); *B65H 5/36* (2013.01); *B65H 85/00* (2013.01); *B65H 2402/45* (2013.01); *B65H 2404/611* (2013.01); *B65H 2801/06* (2013.01)

(58) Field of Classification Search

CPC ... B65H 3/44; B65H 3/66; B65H 5/26; B65H 5/36; B65H 85/00; B65H 2402/45; B65H 2404/611; B65H 2801/06; G03G 15/6529

USPC ..... 271/9.09, 9.13

See application file for complete search history.

(56) References Cited

U.S. PATENT DOCUMENTS

| | | | | |
|---|---|---|---|---|
| 8,267,400 | B2 * | 9/2012 | Nishikata | B65H 5/062 271/264 |
| 8,857,812 | B2 * | 10/2014 | Yamamoto | B65H 1/04 271/162 |
| 2014/0035219 | A1 * | 2/2014 | Yamamoto | B65H 5/26 271/9.09 |
| 2015/0284196 | A1 * | 10/2015 | Mitsui | B65H 1/04 271/9.09 |

FOREIGN PATENT DOCUMENTS

| | | |
|---|---|---|
| JP | 2004-354422 A | 12/2004 |
| JP | 2006-282381 A | 10/2006 |

* cited by examiner

*Primary Examiner* — David H Bollinger

(74) *Attorney, Agent, or Firm* — Canon U.S.A., Inc. IP Division

(57) ABSTRACT

A sheet conveying device includes a third pivoting guide member located between a first pivoting guide member on a side of fixed guide members and a second pivoting guide member on a side of an opening/closing member. In a state in which an upstream conveying path and a re-conveying path are formed, the first pivoting guide member pivots toward the third pivoting guide member to expand the upstream conveying path when pushed by a sheet conveyed from the upstream conveying path, and the third pivoting guide member pivots toward the first pivoting guide member to expand the re-conveying path when pushed by a sheet conveyed from the re-conveying path.

9 Claims, 6 Drawing Sheets

SHEET CONVEYING DEVICE AND IMAGE FORMING APPARATUS

BACKGROUND OF THE INVENTION

Field of the Invention

Embodiments of the present invention relate to a sheet conveying device in an image forming apparatus such as a copying machine or a printer, and to an image forming apparatus including the sheet conveying device.

Description of the Related Art

In widely popular forming apparatuses such as an electrophotographic image forming apparatus, images are formed on sheets conveyed to an image forming section by a sheet conveying device. In such an image forming apparatus, sheets are fed out one by one from a feeding unit such as a sheet supplying cassette or a manual feeding tray, and are conveyed through sheet conveying paths. While the sheets pass through a transfer unit and a fixing unit during conveyance, images are formed on the sheets. A plurality of sheet conveying paths are provided to respond to selection of feeding units and selection of surfaces on which an image is to be formed, that is, one surface or both surfaces of each sheet, and merge into one sheet conveying path immediately before a registration roller pair that conveys the sheets to the transfer unit. In this conveyance merging part of the sheet conveying paths, a plurality of guide members overlap to merge the sheet conveying paths into one sheet conveying path.

However, to cope with the occurrence of a sheet jam (paper jam), such a conveyance merging part is required to have a structure in which an opening/closing mechanism is supported openably and closably relative to a main body of the device and jam recovery can be easily performed in a state in which the conveyance merging part is accessed and the conveying paths are opened by opening the opening/closing member when the sheet jam occurs. Japanese Patent Laid-Open No. 2006-282381 proposes a sheet conveying device in which jam recovery is performed in a conveyance merging part by opening an opening/closing member. In this structure, one of guide members overlapping to form the conveyance merging part is supported by the opening/closing member and the other guide member is fixed to a main body of the device by a latch. In this device, the guide member that supports rollers is held while being elastically biased toward the main body of the device on an inner side of the opening/closing member. This facilitates jam recovery operation, maintains the interval between the guide members, and positions the rollers with high accuracy.

With recent size reduction of image forming apparatuses, there is a conveyance merging part for duplex printing that is sharply curved by a large curvature immediately before a registration roller pair. For this reason, a sheet is not smoothly conveyed, and cannot properly enter the registration roller pair. This may cause folding of a leading edge portion of the sheet in a nip area between the registration roller pair, deviation of the sheet conveyance timing, or a sheet jam due to oblique conveyance. Japanese Patent Laid-Open No. 2004-354422 proposes a sheet conveying device in which a movable guide member (resin film) capable of pivoting and having a distal end in contact with a fixed guide member is disposed in a space between the fixed guide member and a registration roller pair. In this device, when a sheet is conveyed, it is corrected for skew by bending force of the movable guide member to optimize the entry of the sheet into the registration roller pair.

However, when the structure described in Japanese Patent Laid-Open No. 2006-282381 is complicated when applied to the section where a plurality of guide members overlap to form the conveyance merging part of the sheet conveying paths. For this reason, it is difficult to achieve both accurate positioning of the guide members and improved jam recovery performance with a simple structure. In the structure described in Japanese Patent Laid-Open No. 2004-354422, when jam recovery is performed in a state in which an opening/closing member is opened, the movable guide member interferes and hinders smooth jam recovery.

SUMMARY OF THE INVENTION

Embodiments of the present invention provide a sheet conveying device and an image forming apparatus that can enhance jam recovery performance and positioning accuracy of a pivoting guide member without using a movable guide member or the like and that allow a conveyed sheet to smoothly pass through a conveyance merging part regardless of stiffness of the sheet.

A sheet conveying device a device body, an opening/closing member supported to open and close relative to the device body, a conveyance merging part where sheets conveyed from different directions join, at least a first sheet conveying path and a second sheet conveying path configured to convey sheets to the conveyance merging part, a fixed guide member fixed to the device body, a first pivoting guide member supported pivotally on a common axis between the fixed guide member and the opening/closing member and disposed on a side of the fixed guide member, a second pivoting guide member supported pivotally on the common axis between the fixed guide member and the opening/closing member and disposed on a side of the opening/closing member, and a third pivoting guide member supported pivotally on the common axis between the fixed guide member and the opening/closing member and located between the first pivoting guide member and the second pivoting guide member. In a state in which the first and second sheet conveying paths are formed, the first pivoting guide member pivots toward the third pivoting guide member to expand the first sheet conveying path when pushed by a sheet conveyed from the first sheet conveying path, and the third pivoting guide member pivots toward the first pivoting guide member to expand the second sheet conveying path when pushed by a sheet conveyed from the second sheet conveying path.

Further features of the present invention will become apparent from the following description of exemplary embodiments with reference to the attached drawings.

DESCRIPTION OF THE EMBODIMENTS

Embodiments of the present invention will be described below with reference to the drawings. In the following description, the positional relations in the upper, lower, rightward, and leftward directions are based on a state in which an image forming apparatus is viewed from the front side (point of sight of FIGS. 1A and 1B).

First Embodiment

Image Forming Apparatus

Figure 1A:
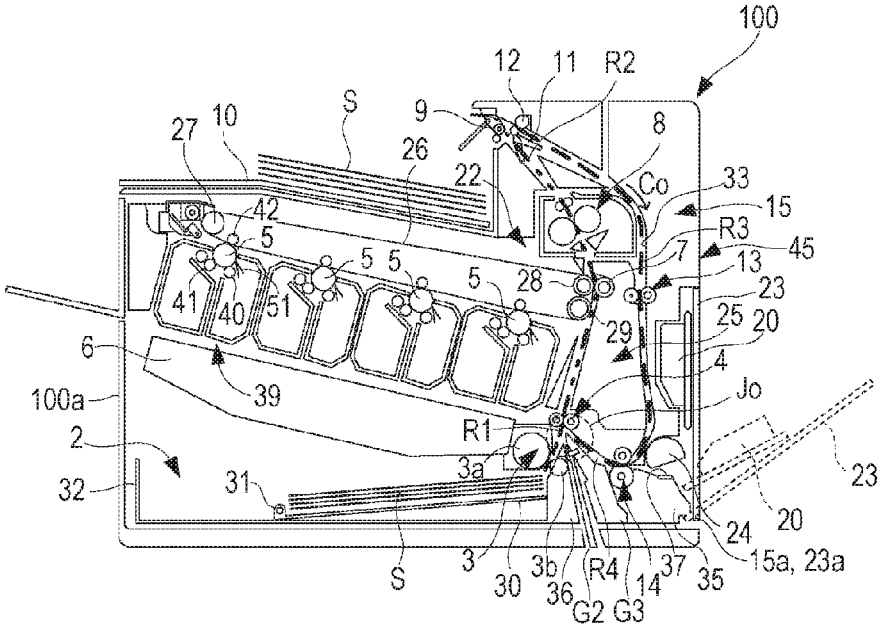
FIG. 1A schematically illustrates an overall configuration of an image forming apparatus according to a first embodiment of the present invention, and FIG. 1B schematically illustrates a state in which an opening/closing member is opened.
Figure 1B:
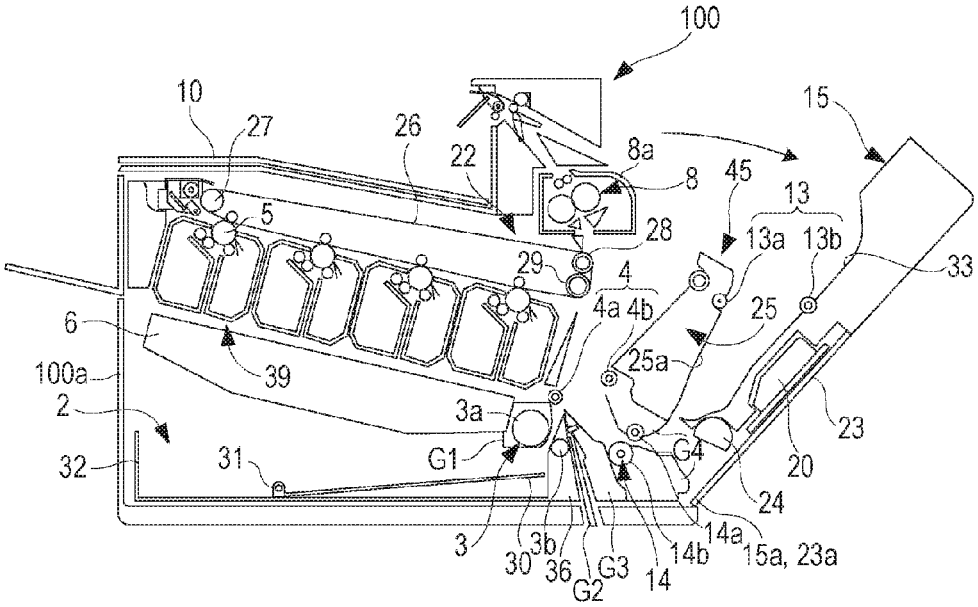

FIGS. 1A and 1B illustrate an outline configuration of an image forming apparatus 100 including a sheet conveying device 45 according to a first embodiment. As illustrated in FIGS. 1A and 1B, the image forming apparatus 100 is, for example, a full-color laser beam printer. The image forming apparatus 100 includes, inside an apparatus body 100*a* (printer main body) serving as a main body of the image forming apparatus, an image forming section 22 for forming an image on a sheet S and a fixing unit 8 for fixing the image on the sheet S. In an upper part of the apparatus body 100*a*, a discharge tray 10 in which sheets S are to be discharged is provided. In a lower part of the apparatus body 100*a*, a sheet feeding section 2 including a sheet supplying cassette 32 is disposed. In the apparatus body 100*a*, an upstream conveying path R1 is provided to convey a sheet S fed out from the sheet supplying cassette 32 to the image forming section 22. The sheet supplying cassette 32 includes a loading tray 30 supported pivotally on a pivot axis 31 in a rear end portion so that sheets S are stacked thereon.

In an upper front end portion of the sheet supplying cassette 32 in the sheet feeding section 2, a separating and feeding roller pair 3 is disposed to separate and feed sheets S stacked on the loading tray 30 one by one. In a front end portion of the sheet supplying cassette 32 in the sheet feeding section 2, a projecting portion 36 projects to be opposed to the front end portion. A feeding roller 3*a* serving as a feeding member is rotatably supported in a fixed guide member G1 opposed to the projecting portion 36. The projecting portion 36 rotatably supports a separation roller 3*b* that is in contact with the feeding roller 3*a* to constitute the separating and feeding roller pair 3 together with the feeding roller 3*a*. A sheet S separated by the separating and feeding roller pair 3 is conveyed further downstream by a registration roller pair 4.

On one side (right side in FIGS. 1A and 1B) of the apparatus body 100*a*, an opening/closing member 15 is supported to open and close relative to the apparatus body 100*a*. A lower end portion of the opening/closing member 15 is supported pivotally on a pivot axis 15*a*. Further, in a lower part of the opening/closing member 15, a manual feeding tray 23 is supported pivotally on a pivot axis 23*a* coaxial with the pivot axis 15*a*. The manual feeding tray 23 is opened and closed relative to the opening/closing member 15. The opening/closing member 15 has a duplex outer guide 33 serving as one of guide members that form a duplex conveying path R3. As the other guide member that forms the duplex conveying path R3, a case outer side surface 8*a* of a fixing unit 8, a guide surface 25*a* of a duplex inner guide 25, and a pivoting guide member G4 are arranged in order from an upstream side in a sheet conveying direction Co in the apparatus body 100*a*.

The opening/closing member 15 is pivoted by an operator, such as a user, at the time of jam recovery. The opening/closing member 15 is pivoted on the pivot axis 15*a* to open from the apparatus body 100*a*. When a sheet jam occurs, the operator opens the opening/closing member 15 from a closed state of FIG. 1A to an open state of FIG. 1B. When the upstream conveying path R1, a downstream conveying path R2, the duplex conveying path R3, and a re-conveying path R4 are then opened, a sheet S staying inside the conveying paths can be taken out for jam recovery.

The manual feeding tray 23 is disposed in a lower part of an outer side surface of the opening/closing member 15. A pivot base portion of the manual feeding tray 23 is supported to open and close relative to the opening/closing member 15. The manual feeding tray 23 is provided with a pair of right and left side regulation plates 20, and sheets S to be manually fed are stacked between the side regulation plates 20. A separating pad 37 is disposed at a position in the apparatus body 100*a* corresponding to a front end portion of the manual feeding tray 23. A feeding roller 24 formed by a semicircular roller is rotatably disposed at a position in the apparatus body 100*a* opposed to and located above the separating pad 37.

A re-feeding roller pair 14 is disposed on the downstream side of the feeding roller 24 in the feeding direction. The re-feeding roller pair 14 also functions as a pulling-out roller pair for pulling out sheets S fed out from the manual feeding tray 23 by rotation of the feeding roller 24. The separating pad 37 is in pressure contact with the feeding roller 24 to form a separation nip portion, and serves to separate the sheets S fed from the feeding roller 24 one by one at the separation nip portion.

The image forming section 22 adopts a so-called four-drum full-color system including a laser scanner 6, four process cartridges 39, and an intermediate transfer belt 26. The process cartridges 39 respectively form toner images of colors of yellow (Y), magenta (M), cyan (C), and black (Bk). Each of the process cartridges 39 includes a photosensitive drum 5 serving as an image bearing member, a charging roller 40 serving as a charging unit, a developing roller 41 serving as a developing unit, and a cleaner 51 serving as a cleaning member. The image forming section 22 forms an image forming device that forms an image on a conveyed sheet.

In an intermediate transfer unit, the intermediate transfer belt 26 serving as an intermediate transfer member is wound around a driving roller 28, a tension roller 27, and so on, and is disposed above the four process cartridges 39. The intermediate transfer belt 26 is disposed in contact with photosensitive drums 5 in the process cartridges 39, and is rotated in the counterclockwise direction in FIGS. 1A and 1B by the driving roller 28 that is driven by an unillustrated driving unit.

The intermediate transfer unit includes primary transfer rollers 42 in contact with an inner peripheral surface of the intermediate transfer belt 26 at positions opposed to the photosensitive drums 5. Nip portions between the intermediate transfer belt 26 and the photosensitive drums 5 form primary transfer portions. The image forming section 22 includes a secondary transfer roller 7 in contact with an outer peripheral surface of the intermediate transfer belt 26 at a position opposed to the driving roller 28. A nip portion between the secondary transfer roller 7 and the intermediate transfer belt 26 forms a secondary transfer portion where a toner image born on the intermediate transfer belt 26 is to be transferred onto a sheet S.

In the above-described process cartridges 39, electrostatic latent images are drawn on surfaces of the photosensitive drums 5 by the laser scanner 6, and toner is then supplied from the developing roller 41, so that color toner images charged with a negative polarity are formed. The toner images are multi-transferred (primary-transferred) in order onto the intermediate transfer belt 26 at the first transfer portions by application of a transfer bias voltage of a positive polarity to the primary transfer rollers 42, and form a full-color toner image on the intermediate transfer belt 26.

In parallel with such a toner-image forming process, a sheet S from the upstream conveying path R1 is conveyed toward the registration roller pair 4, and is subjected to skew correction by the registration roller pair 4. The registration roller pair 4 conveys the sheet S to the secondary transfer portion in timing to the transfer timing of the full-color toner image formed on the intermediate transfer belt 26. The toner image born on the intermediate transfer belt 26 is secondary-transferred onto the sheet S at the secondary transfer portion by application of a transfer bias voltage of a positive polarity to the secondary transfer roller 7.

Then, the sheet S on which the color toner image is transferred is heated and pressurized in the fixing unit 8 to be fixed on the sheet S. The sheet S on which the image is fixed is discharged and stacked on the discharge tray 10 by a discharge roller pair 9. When an image is formed on only one surface of the sheet S, image formation is performed through the above-described process.

In contrast, when an image is formed on each surface of a sheet S, after the sheet S passes through a fixing nip portion in the fixing unit 8 in a period of image formation on a first surface, it is conveyed to a switchback roller pair 12 capable of forward and reverse rotation by the turn of a switch member 11. The sheet S is discharged halfway to the outside of the image forming apparatus 100 by the switchback roller pair 12, is taken into the apparatus body 100*a* again by reverse rotation of the switchback roller pair 12, and is then conveyed through the duplex conveying path R3 including a duplex conveying roller pair 13 and the re-conveying path R4 including a re-feeding roller pair 14. The sheet S is conveyed to the image forming section 22 again via the re-feeding roller pair 14. The sheet S is conveyed via the registration roller pair 4, and an image is formed on a second surface of the sheet S similarly to the first surface. After passing through the fixing nip portion in the fixing unit 8, the sheet S is discharged and stacked on the discharge tray 10.

When a sheet jam occurs during conveyance of the sheet S through the upstream conveying path R1, the downstream conveying path R2, the duplex conveying path R3, and the re-conveying path R4, jam recovery is performed in a state in which the conveying paths R1 to R4 are opened by opening the opening/closing member 15 from the apparatus body 100*a*, as illustrated in FIG. 1B. The upstream conveying path R1 and the re-conveying path R4 form at least two sheet conveying paths that convey the sheet S to a conveyance merging part Jo. The upstream conveying path R1 forms a first conveying path of the sheet conveying paths, and the re-conveying path R4 forms a second conveying path of the sheet conveying paths. The re-conveying path R4 conveys the sheet S to the conveyance merging part Jo after the sheet S is conveyed through the upstream conveying path R1 and is subjected to image formation (predetermined processing).

Positioning Structure for Pivoting Guide Members

Figure 2:
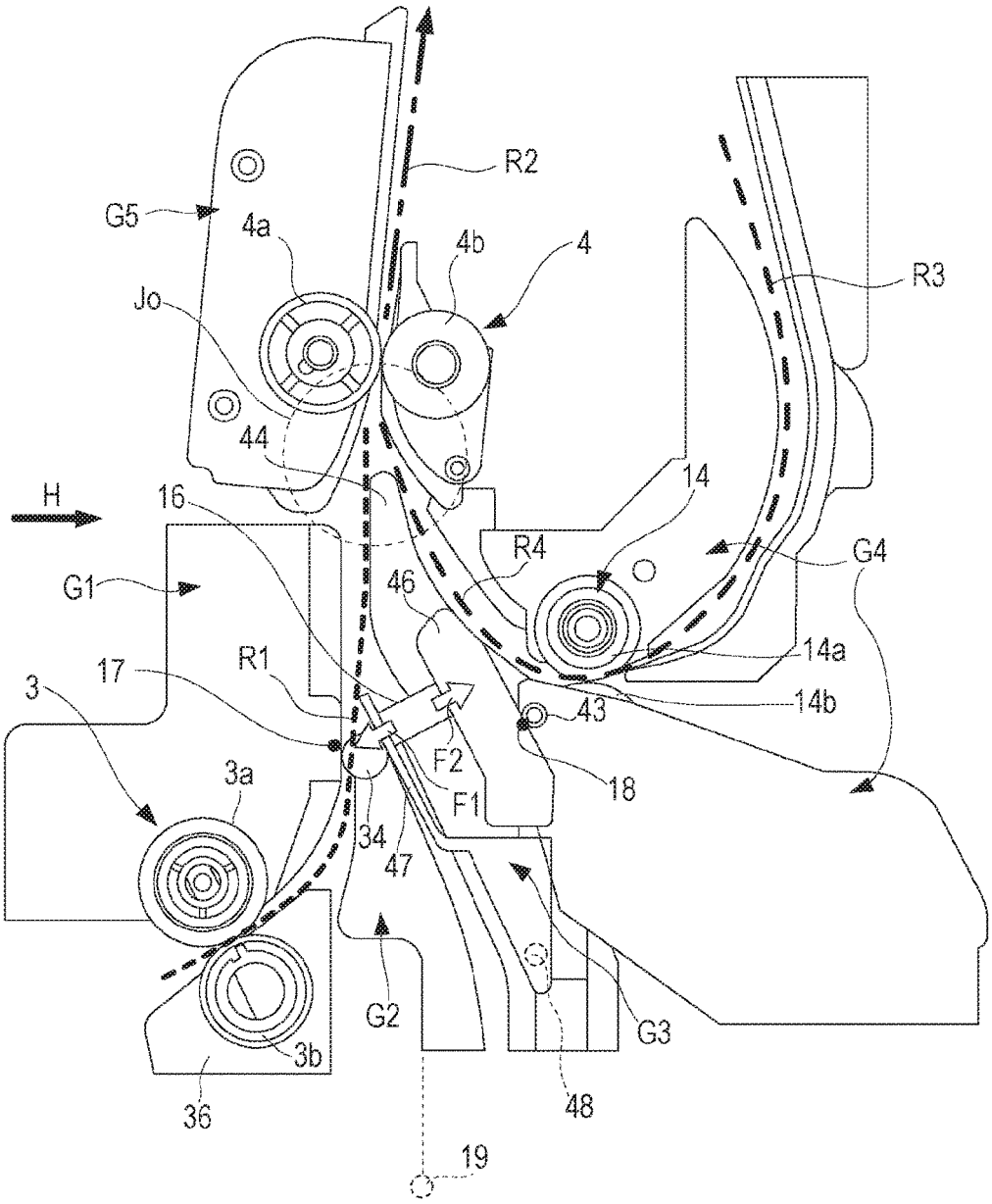
FIG. 2 schematically illustrates a positioning structure for pivoting guide members in the first embodiment.

Next, a description will be given of a positioning structure for pivoting guide members according to the first embodiment. FIG. 2 schematically illustrates the positioning structure for the pivoting guide members in the first embodiment.

As illustrated in FIG. 2, a sheet S fed out from the sheet supplying cassette 32 by the separating and feeding roller pair 3 passes through the upstream conveying path R1 serving as the first conveying path, and is conveyed to the conveyance merging part Jo. The conveyance merging part Jo are defined by fixed guide members G1 and G5 fixed to the apparatus body 100*a*, and pivoting guide members G2, G3, and G4 supported pivotally on a common axis 19 relative to the apparatus body 100*a*. In the conveyance merging part Jo where sheets conveyed from different directions join, the upstream conveying path R1 and the re-conveying path R4 merge into one downstream conveying path R2.

As illustrated in FIGS. 3A to 3D, the pivoting guide members G2 to G4 are pivotally supported in the apparatus body 100*a* by an unillustrated pivot support mechanism. The common axis 19 is a virtual pivot axis located below the pivoting guide members G2, G3, and G4. The pivoting guide members G2, G3, and G4 can pivot independently of the opening/closing motion of the opening/closing member 15. While the pivoting guide members G2 to G4 are supported to pivot on the axis 19 and the opening/closing member 15 pivots on the pivot axis 15*a* in the first embodiment, the present invention is not limited to this structure. That is, the rotation center of the pivoting guide members G2 to G4 can be the same as the rotation center of the opening/closing member 15.

The pivoting guide members G2 to G4 are supported to pivot in order on the common axis 19 between the fixed guide members G1 and G5 and the opening/closing member 15, and can form and release, for example, the upstream conveying path R1 and the re-conveying path R4. Between the pivoting guide member (first pivoting guide member) G2 and the pivoting guide member (third pivoting guide member) G3, a pressing member 16 is interposed as a biasing member. The pivoting guide member G3 is located between the pivoting guide member G2 on the fixed guide member side and the pivoting guide member (second pivoting guide member) G4 on the opening/closing member side.

Figure 4A:
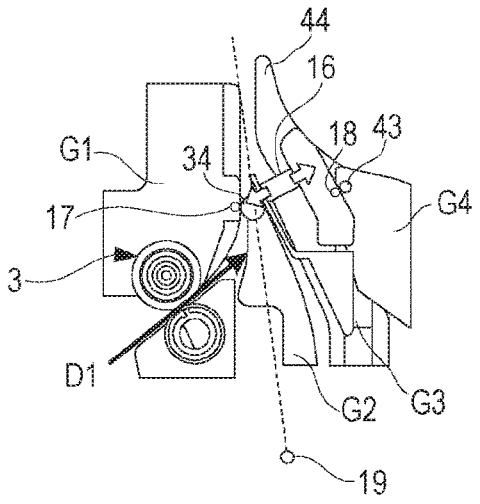
FIG. 4A is a schematic side view illustrating an entry direction in which a sheet enters the conveyance merging part from an upstream conveying path.
Figure 4B:
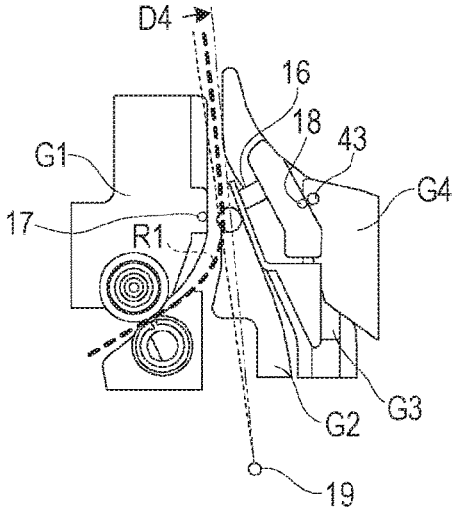
FIG. 4B is a schematic side view illustrating a state in which the sheet enters in the entry direction of FIG. 4A.
Figure 4C:
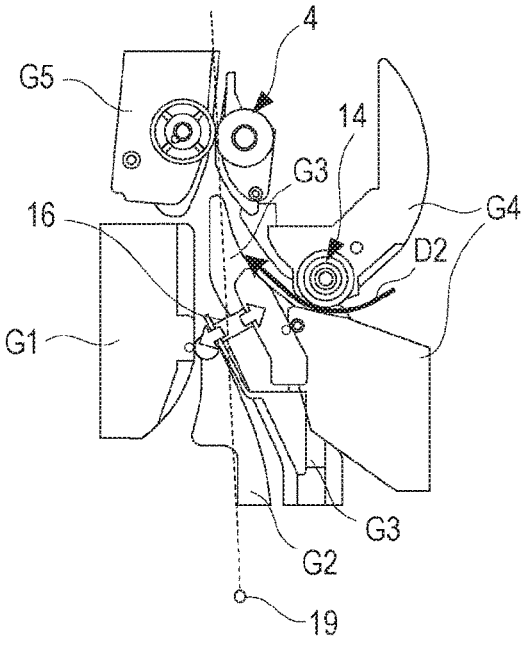
FIG. 4C is a schematic side view illustrating an entry direction in which a sheet enters the conveyance merging part from a re-conveying path.

The pressing member (biasing member) 16 biases the pivoting guide member G2 and the pivoting guide member G3 in directions to separate from each other. The pressing member 16 is supported by the pivoting guide member G3 while being compressed between a fixed supporting portion 46 and a movable supporting portion 47 (FIG. 2) provided in the pivoting guide member G3. The movable supporting portion 47 is supported pivotally on an axis 48 (FIG. 2) in a lower part of the pivoting guide member G3, and pivots relative to the fixed supporting portion 46 according to the compressed state of the pressing member 16. Thus, the pivoting guide member G2 is biased in a direction opposite from an entry direction D1 of the sheet S (FIG. 4A), and the pivoting guide member G3 is biased in a direction opposite from an entry direction D2 of the sheet S (FIG. 4C). As the pressing member 16, for example, a soft elastic member, such as rubber, a compression spring, or a leaf spring can be used.

The upstream conveying path R1 and the re-conveying path R4 merge with the downstream conveying path R2 in the conveyance merging part Jo defined by the overlapping pivoting guide members G2 and G3 of FIG. 2 before (on the upstream side of) the registration roller pair 4 composed of rollers 4*a* and 4*b*. The duplex conveying path R3 is provided between the pivoting guide member G3 and the pivoting guide member G4.

The upstream conveying path R1 is provided between the fixed guide member G1 and the pivoting guide member G2 and between the fixed guide member G1 and the pivoting guide member G3 immediately before (immediately upstream of) the conveyance merging part Jo. That is, in FIG. 2, the upstream conveying path R1 is formed by the pivoting guide member G2 and the pivoting guide member G3 when viewed in a direction of arrow H from the fixed guide members G1 and G5. The pivoting guide member G3 has a protruding guide portion 44 (protruding portion) protruding from the pivoting guide member G2 toward the conveyance merging part Jo in a state in which the pivoting guide member G2 and the pivoting guide member G3 overlap to form the upstream conveying path R1 when viewed from the lower axis 19. According to this structure, a sheet S conveyed through the upstream conveying path R1 is properly guided to the nip portion between the registration roller pair 4 by the protruding guide portion 44 while being guided by the pivoting guide member G2 and the pivoting guide member G3.

The pivoting guide member G2 and the pivoting guide member G3 are biased by the pressing member 16 in the directions to separate from each other (directions of arrows F1 and F2 in FIG. 2), and are respectively positioned by abutment on positioning portions 17 and 18 in a closed state of the opening/closing member 15. That is, the pivoting guide member G2 is positioned with a pair of abutting portions 34, which correspond to both widthwise ends of the upstream conveying path R1 on the upper side, abutting on the positioning portion 17 of the fixed guide member G1 while being biased by the pressing member 16. The pivoting guide member G3 is positioned with the positioning portion 18, which corresponds to both widthwise ends of the re-conveying path R4 in the middle portion, abutting on a pair of abutting portions 43 provided in the pivoting guide member G4 while being biased by the pressing member 16. Thus, the pivoting guide member G2 and the pivoting guide member G3 can be positioned with high accuracy without interposing a fixing member formed by a lock mechanism, such as a latch, therebetween.

Operation in Formation State of Sheet Conveying Paths

Figure 4D:
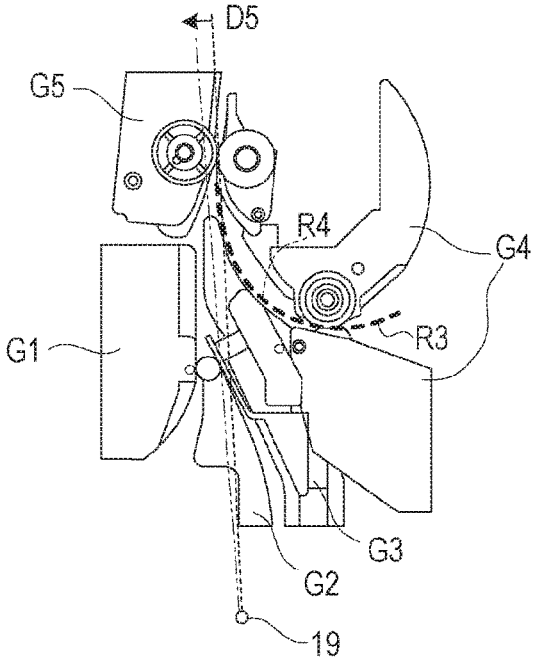
FIG. 4D is a schematic side view illustrating a state in which the sheet enters in the entry direction of FIG. 4C.

In the above-described sheet conveying device 45, the pivoting guide members G2, G3, and G4 are brought into contact with the fixed guide members G1 and G5 in order to form the conveyance merging part Jo together with the upstream conveying path R1, the downstream conveying path R2, the duplex conveying path R3, and the re-conveying path R4, as illustrated in FIG. 2. In this formation state, when the pivoting guide member G2 is pushed by a sheet S conveyed from the upstream conveying path R1 (first conveying path), it pivots toward the pivoting guide member G3 (toward the third pivoting guide member) and can expand the upstream conveying path R1 (FIGS. 4A and 4B). When the pivoting guide member G3 is pushed by a sheet S conveyed from the re-conveying path R4 (second conveying path), it pivots toward the pivoting guide member G2 (toward the first pivoting guide member), and can expand the re-conveying path R4 (FIGS. 4C and 4D).

That is, as illustrated in FIG. 4A, when the sheet S conveyed through the upstream conveying path R1 (FIG. 2) hits the pivoting guide member G2 from the entry direction D1, the pivoting guide member G2 operates as follows. That is, when the reactive force of the sheet S hitting the pivoting guide member G2 is larger than the force of the pressing member 16 to bias the positioning portion 17 of the pivoting guide member G2, the pressing member 16 is compressed, and the pivoting guide member G2 pivots on the axis 19 in a pivot direction D4, as illustrated in FIG. 4B. By this pivot motion of the pivoting guide member G2, the curvature of the upstream conveying path R1 is decreased (the radius of curvature is increased) so that the curve becomes gentle. Hence, conveyability of the sheet S in the upstream conveying path R1 is improved.

Similarly, as illustrated in FIG. 4C, when the sheet S conveyed through the duplex conveying path R3 hits the pivoting guide member G3 from the entry direction D2, the pivoting guide member G3 operates as follows. That is, when the reactive force of the sheet S hitting the pivoting guide member G3 is larger than the force of the pressing member 16 to bias the positioning portion 18 in the pivoting guide member G3, the pressing member 16 is compressed, and the pivoting guide member G3 pivots on the axis 19 in a pivot direction D5, as illustrated in FIG. 4D. By this pivot motion of the pivoting guide member G3, the curvature of the re-conveying path R4 is decreased so that the curve becomes gentle. Hence, conveyability of the sheet S in the re-conveying path R4 is improved.

When the sheet S to be conveyed has high stiffness (is firm) like thick paper, it is difficult for the sheet S to be curved along the conveying paths and to be conveyed through the conveying paths having a large curvature (a small radius of curvature) like the duplex conveying path R3 and the re-conveying path R4. Here, it is highly effective for improvement in sheet conveyability to pivot the pivoting guide member G3 in the pivot direction D5 so that the curvature (increase the radius of curvature) of the re-conveying path R4 decreases.

In the first embodiment, when the pivoting guide member G2 or the pivoting guide member G3 is pivoted by the reactive force received from the conveyed sheet S, the sheet conveying path length may be changed. However, in a case in which the sheet S hits the pivoting guide member G2 or the pivoting guide member G3, the pivoting guide member G2 or the pivoting guide member G3 is pivoted by the reactive force of the sheet S mainly when the sheet S has high stiffness like thick paper. Since the conveying speed is low in such a case, even when the sheet conveying path length is slightly changed by the pivot motion of the guide member, there is no serious problem, or rather sheet conveyability of thick paper can be improved.

Operation of Opening Pivoting Guide Members

Next, a description will be given of an operation of opening the pivoting guide members in the first embodiment.

That is, when a jam (paper jam) of the sheet S occurs in the sheet conveying path, the opening/closing member 15 is opened from the apparatus body 100*a*, and the pressing force applied from the opening/closing member 15 to the pivoting guide member G4 is removed. In this state, the pivoting guide member G4, the pivoting guide member G3, and the pivoting guide member G2 are pivoted in this order toward the opening/closing member 15 (FIGS. 3B, 3C, and 3D). Thus, the pivoting guide member G2 is released from the state in which the abutting portions 34 abut on the positioning portion 17, the pivoting guide member G3 is released from the state in which the positioning portion 18 abuts on the abutting portions 43, and the pivoting guide member G2 and the pivoting guide member G3 are allowed to pivot independently of the opening/closing operation of the opening/closing member 15. For this reason, the upstream conveying path R1, the downstream conveying path R2, the duplex conveying path R3, and the re-conveying path R4 are opened (also see FIGS. 1A and 1B).

In this way, in the first embodiment, the pivoting guide members G2, G3, and G4 are positioned and fixed without using any fixing member formed by a lock mechanism such as a latch. Thus, the upstream conveying path R1, the downstream conveying path R2, the duplex conveying path R3, and the re-conveying path R4 can be opened only by opening the opening/closing member 15 without releasing the lock mechanism. This can facilitate the jam recovery operation.

According to the above-described first embodiment, high-accuracy positioning of the pivoting guide members G2, G3, and G4 that overlap to form the conveyance merging part Jo and improved jam recovery performance in the conveyance merging part Jo can be both achieved by the simple structure. That is, when jam recovery is performed, the pivoting guide members G2, G3, and G4 are pivoted in order by opening the opening/closing member 15, and the conveying paths R1 to R4 and the conveyance merging part Jo where the conveying paths merge can be easily opened. This facilitates the jam recovery operation.

Even in the conveyance merging part Jo where the curvature is large and the curve is sharp as in the sheet conveying path during duplex printing, sheet conveyability can be improved. That is, the conveying path is expanded by the pivot motions of the pivoting guide members G2 to G4, which are biased to one another by the pressing member 16, by the reactive force received from the conveyed sheet S, and this decreases the curvature of the conveying path so that the curve becomes gentle. Further, the pivoting guide members G2, G3, and G4, which are biased to one another by the pressing member 16, are pivoted by the reactive force received from the conveyed sheet S when the sheet S hits the pivoting guide members G2 and G3, and the conveying paths are thereby expanded. Thus, even when a sheet having high stiffness like thick paper is conveyed on the sharply curved conveying surface in the conveyance merging part Jo, the curve is made gentle by being pushed by the pressing force at the time of entry of the sheet. This can improve sheet conveyability.

Figure 3A:
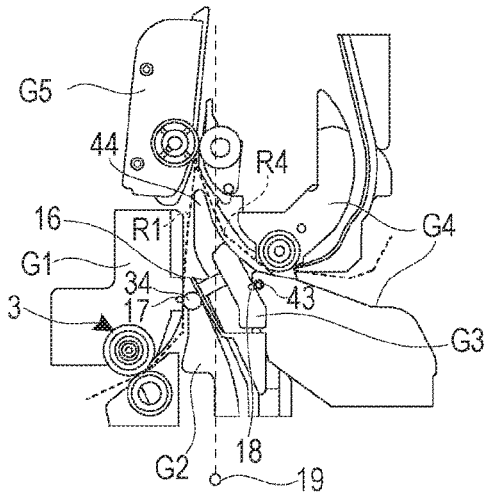
FIG. 3A is a schematic side view illustrating a state in which a conveyance merging part is formed by the pivoting guide members in the first embodiment.
Figure 3B:
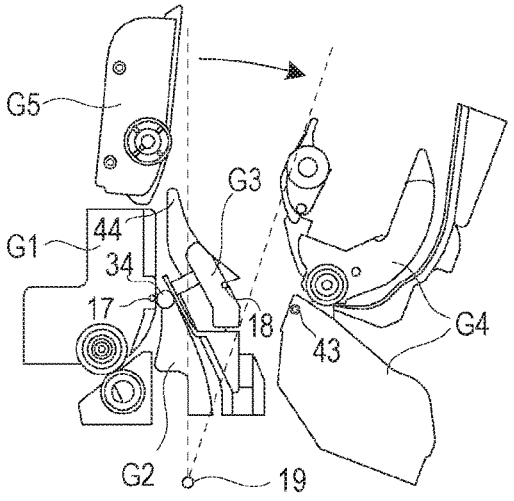
FIG. 3B is a schematic side view illustrating a state in which the outermost pivoting guide member is pivoted from the state of FIG. 3A.
Figure 3C:
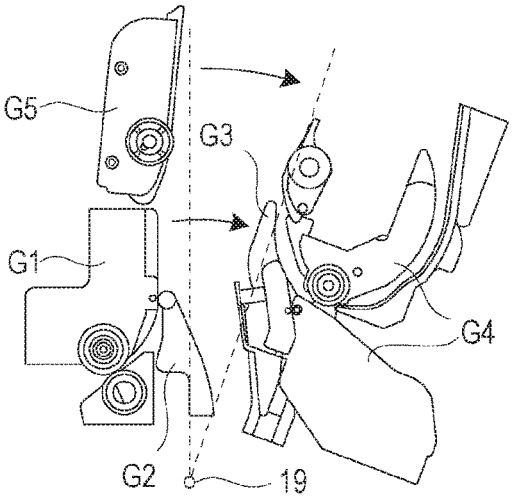
FIG. 3C is a schematic side view illustrating a state in which the next pivoting guide member is further pivoted from the state of FIG. 3B.
Figure 3D:
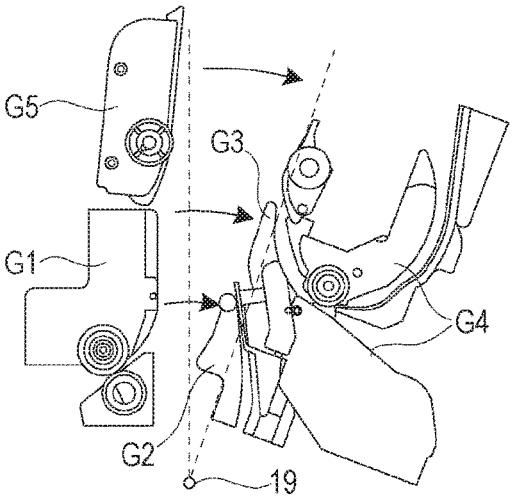
FIG. 3D is a schematic side view illustrating a state in which the next pivoting guide member is further pivoted from the state of FIG. 3C.

According to the first embodiment, when the opening/closing member 15 is closed toward the apparatus body 100*a* to bring about the state illustrated in FIGS. 2 and 3A, the pivoting guide members G2 to G4 are biased to one another by the pressing member 16, and are positioned by properly abutting on the positioning portions. Thus, the pivoting guide members G2, G3, and G4 can be easily and reliably positioned, and high-accuracy positioning of the pivoting guide members G2, G3, and G4 can be ensured only by closing the opening/closing member 15 toward the apparatus body 100*a* in the state of FIG. 2. For this reason, the fixing member, such as a lock mechanism, for fixing the pivoting guide members G2, G3, and G4 is not necessary.

Further, the pivoting guide member G2 is positioned with the pair of abutting portions 34 abutting on the positioning portion 17 of the fixed guide member G1 while being biased by the pressing member 16. The pivoting guide member G3 is positioned with the positioning portion 18 abutting on the pair of abutting portions 43 of the pivoting guide member G4 while being biased by the pressing member 16. Thus, even when a sheet having low stiffness (not firm) like thin paper is conveyed, it is allowed to smoothly pass through the upstream conveying path R1 and the re-conveying path R4.

Second Embodiment

Figure 5:
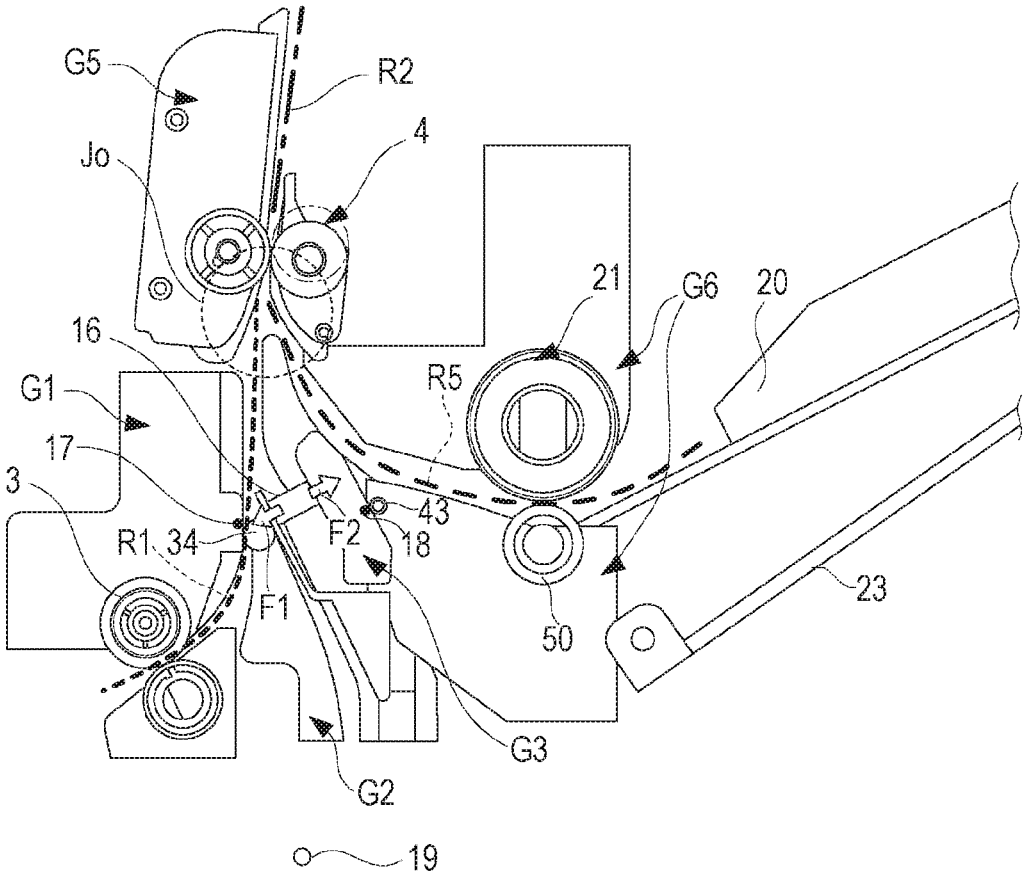
FIG. 5 schematically illustrates a positioning structure for pivoting guide members according to a second embodiment of the present invention.
Figure 6A:
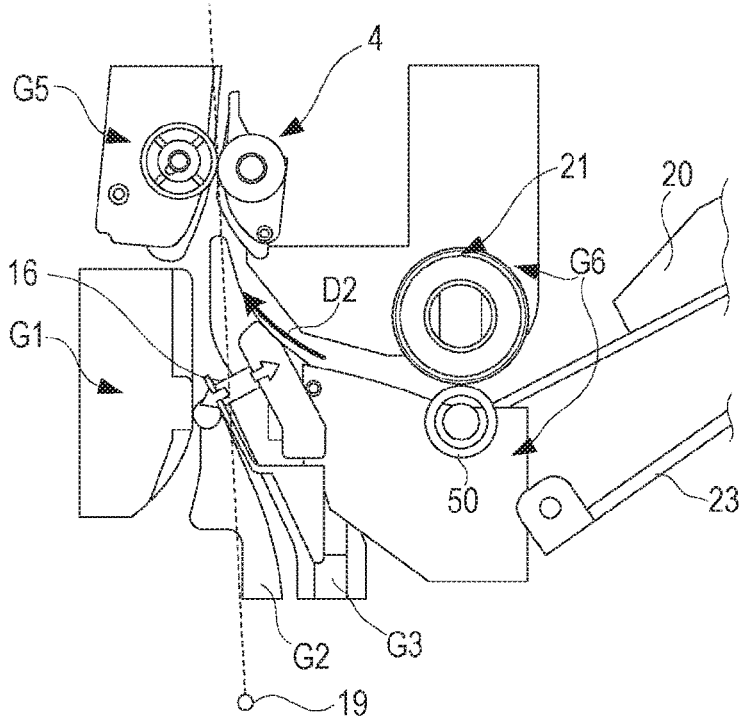
FIG. 6A is a schematic side view illustrating an entry direction in which a sheet enters a conveyance merging part from a manual feeding tray in the second embodiment.
Figure 6B:
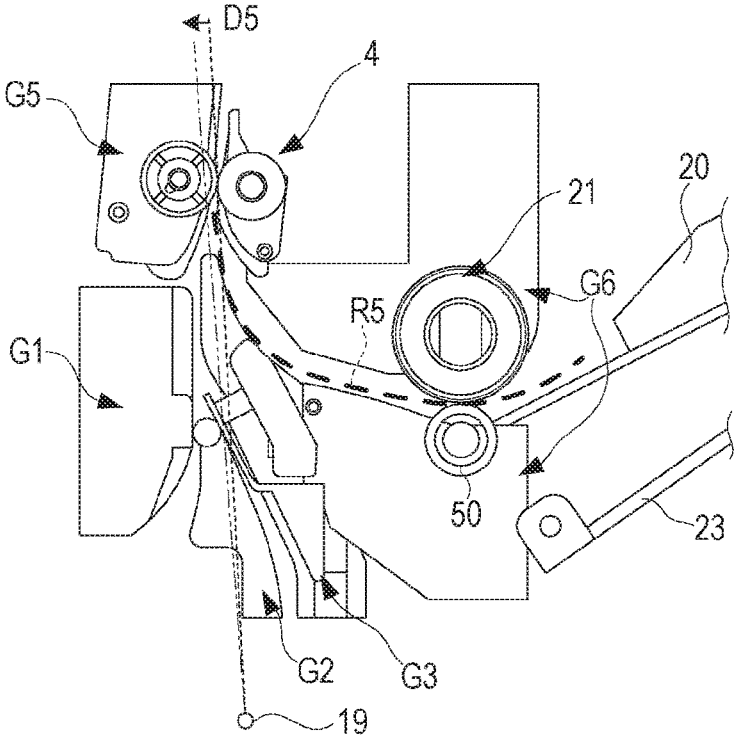
FIG. 6B is a schematic side view illustrating a state in which the sheet enters in the entry direction of FIG. 6A.

Next, a sheet conveying device and an image forming apparatus according to a second embodiment of the present invention will be described with reference to FIGS. 5, 6A, and 6B. FIG. 5 schematically illustrates a positioning structure for pivoting guide members according to the second embodiment. FIG. 6A is a schematic side view illustrating an entry direction D2 of a sheet in which the sheet enters a conveyance merging part from a manual feeding tray in the second embodiment, and FIG. 6B is a schematic side view illustrating a state in which the sheet enters in the entry direction D2 of FIG. 6A. Since basic structures in the second embodiment are substantially similar to those adopted in the first embodiment, the same members as those of the first embodiment are denoted by the same reference numerals, and descriptions of the members having the same structures and functions are skipped. To points that are not particularly mentioned in the description of the second embodiment, the description of the first embodiment is applied appropriately.

The above-described first embodiment is applied to the conveyance merging part Jo of the upstream conveying path R1 and the re-conveying path R4 through which a sheet is fed from the sheet supplying cassette 32 and reaches the registration roller pair 4. However, the second embodiment is applied to a conveyance merging part Jo where an upstream conveying path R1 from a sheet supplying cassette 32 merges with a manual conveying path R5 through which a sheet is fed from a manual feeding tray 23 and reaches a registration roller pair 4.

That is, in the second embodiment, the manual conveying path R5 is provided as a second conveying path. The manual conveying path R5 conveys sheets S stacked on a manual feeding tray (manual stacking unit) 23 provided in an apparatus body 100*a* to the conveyance merging part Jo. That is, in the second embodiment, similarly to sheet feeding from a sheet supplying cassette 32, sheets S fed from the manual feeding tray 23 (also see FIGS. 1A and 1B) disposed on a side surface of the apparatus body 100*a* can be sent into the conveyance merging part Jo. The sheets S stacked on the manual feeding tray 23 are sequentially fed out one by one from the uppermost sheet by a feeding roller 21 (the semi-circular feeding roller 24 in FIGS. 1A and 1B) serving as a feeding member.

In the second embodiment, the pivoting guide member G4 serving as the second pivoting guide member in the first embodiment is replaced with a pivoting guide member (second pivoting guide member) G6 that conveys sheets S from the manual feeding tray 23 to the conveyance merging part Jo via the manual conveying path R5. Thus, sheets S stacked on the manual feeding tray 23 are conveyed to the manual conveying path R5 by a feeding roller 21 disposed in a center portion of the pivoting guide member (second pivoting guide member) G6 and a separating roller 50 at a position opposed to the feeding roller 21. In the second embodiment, fixed guide members G1 and G5 and pivoting guide members G2, G3, and G6 overlapping with one another form the upstream conveying path R1 and a downstream conveying path R2, and the pivoting guide member G3 and the pivoting guide member G6 form the manual conveying path R5. In the second embodiment, the pivoting guide member G6 is supported pivotally on an axis 19 together with the pivoting guide members G2 and G3, similarly to the pivoting guide member G4 of the first embodiment.

A pressing member (biasing member) 16 is disposed between the pivoting guide member G2 and the pivoting guide member G3, and presses the pivoting guide member G2 and the pivoting guide member G3. The pivoting guide member G2 and the pivoting guide member G3 are respectively biased in directions of arrows F1 and F2 of FIG. 5 by being pressed, and are positioned by abutting on positioning portions 17 and 18. For this reason, the pivoting guide member G2 and the pivoting guide member G3 can be positioned with high accuracy without using a fixing member formed by a lock mechanism such as a latch.

The second embodiment adopting the above-described structures can obtain effects similar to those of the first embodiment.

While the manual conveying path R5 from the manual feeding tray 23 is provided as the second conveying path in the second embodiment, the present invention is not limited thereto. In the structure illustrated in FIG. 1A, the manual conveying path R5 can be a conveying path common to the re-conveying path R4 (see FIG. 2) in the structure of FIG. 1A. While the pivoting guide members G2, G3, and G6 are supported pivotally on the axis 19 and the opening/closing member 15 is supported pivotally on a pivot axis 15*a* in the second embodiment, the present invention is not limited thereto. That is, the rotation center of the pivoting guide members G2, G3, and G6 can be the same as the rotation center of the opening/closing member 15.

While the first and second embodiments of the present invention have been described above, the present invention is not limited to the above-described embodiments, and can be carried out in various modes in a section where a plurality of pivoting guide members overlap to form a conveyance merging part.

While the electrophotographic image forming apparatus 100 is used in the above embodiments, alternatively, for example, an image forming apparatus of an inkjet type that forms an image on a sheet by discharging ink liquid from a nozzle can be used.

According to embodiments of the present invention, it is possible to improve jam recovery performance and positioning accuracy of the pivoting guide members without using a movable guide member and to smoothly pass a conveyed sheet through a conveyance merging part, regardless of stiffness of the sheet.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-248515 filed Dec. 21, 2015, which is hereby incorporated by reference herein in its entirety.

What is claimed is:

1. A sheet conveying device comprising:

a device body;

an opening/closing member supported to open and close relative to the device body;

a conveyance merging part where sheets conveyed from different directions join;

at least a first sheet conveying path and a second sheet conveying path configured to convey sheets to the conveyance merging part;

a fixed guide member fixed to the device body;

a first pivoting guide member supported pivotally on a common axis between the fixed guide member and the opening/closing member and disposed on a side of the fixed guide member;

a second pivoting guide member supported pivotally on the common axis between the fixed guide member and the opening/closing member and disposed on a side of the opening/closing member; and a third pivoting guide member supported pivotally on the common axis between the fixed guide member and the opening/closing member and located between the first pivoting guide member and the second pivoting guide member, wherein, in a state in which the first and second sheet conveying paths are formed, the first pivoting guide member pivots toward the third pivoting guide member to expand the first sheet conveying path when pushed by a sheet conveyed from the first sheet conveying path, and the third pivoting guide member pivots toward the first pivoting guide member to expand the second sheet conveying path when pushed by a sheet conveyed from the second sheet conveying path.

2. The sheet conveying device according to claim 1, further comprising:

a biasing member configured to bias the third pivoting guide member and the first pivoting guide member in directions to separate from each other.

3. The sheet conveying device according to claim 2, wherein the first and third pivoting guide members are positioned by abutting on the fixed guide member and the second pivoting guide member, respectively, while being biased by the biasing member.

4. The sheet conveying device according to claim 2, wherein the biasing member is supported by the third pivoting guide member.

5. The sheet conveying device according to claim 2, wherein the first sheet conveying path is formed by the first pivoting guide member and the third pivoting guide member when viewed from the fixed guide member.

6. The sheet conveying device according to claim 2, wherein the third pivoting guide member has a protruding portion configured to protrude from the first pivoting guide member toward the conveyance merging part in a state in which the third pivoting guide member and the first pivoting guide member overlap to form the first sheet conveying path when viewed from the common axis.

7. The sheet conveying device according to claim 2, wherein the second sheet conveying path is a re-conveying path configured to convey a sheet conveyed from the first sheet conveying path and subjected to predetermined processing to the conveyance merging part.

8. The sheet conveying device according to claim 2, wherein the second sheet conveying path is a manual conveying path configured to convey a sheet stacked on a manual stacking unit provided with the device body to the conveyance merging part.

9. An image forming apparatus comprising:

an image forming unit configured to form an image on a conveyed sheet; and the sheet conveying device according to claim 1.

* * * * *